US006585038B2

(12) United States Patent
Bousquet et al.

(10) Patent No.: US 6,585,038 B2
(45) Date of Patent: Jul. 1, 2003

(54) ARRANGEMENT OF INLET AND OUTLET PIPES FOR AN EVAPORATOR

(75) Inventors: Frédéric Bousquet, La Suze/Sarthe (FR); Sylvain Moreau, Spay (FR); Patrick Samy, Le Mans (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 10/170,434

(22) Filed: Jun. 14, 2002

(65) Prior Publication Data

US 2002/0195236 A1 Dec. 26, 2002

(30) Foreign Application Priority Data

Jun. 20, 2001 (FR) ..... 01 08118

(51) Int. Cl.[7] ..... F28D 1/03
(52) U.S. Cl. ..... 165/153; 165/176
(58) Field of Search ..... 165/152, 153, 165/176

(56) References Cited

U.S. PATENT DOCUMENTS 5,042,577 A 8/1991 Suzumura
5,630,326 A * 5/1997 Nishishita et al. ..... 62/299
5,979,542 A * 11/1999 Inoue et al. ..... 165/133

FOREIGN PATENT DOCUMENTS

| | | | | |
|---|---|---|---|---|
| DE | 43 01 629 A1 | | 7/1994 | |
| DE | 198 14 050 A1 | | 10/1998 | |
| EP | 0 807 794 A1 | | 11/1997 | |
| EP | 0 905 467 A2 | | 3/1999 | |
| GB | 2276937 A | * | 10/1994 | ..... F28F/9/02 |

* cited by examiner

*Primary Examiner*—Allen Flanigan
(74) *Attorney, Agent, or Firm*—Liniak, Berenato & White

(57) ABSTRACT

A plate evaporator comprising a stack of pockets (1) each formed from two dished plates (2, 3) delimiting between them a mutually juxtaposed inlet chamber and outlet chamber (6, 7). One at least of the inlet and outlet pipes (17, 18), disposed at a same end (21) of the stack, communicates with the chambers via an end box (10) interposed between the stack and the pipes. Advantageously, the dimensions of the end box allow a mutual vertical stagger of the pipes (17, 18), facilitating their installation and connection.

12 Claims, 2 Drawing Sheets

ARRANGEMENT OF INLET AND OUTLET PIPES FOR AN EVAPORATOR

The invention relates to a heat exchanger comprising a multiplicity of pockets mutually stacked in a longitudinal direction and each defining two chambers juxtaposed in a lateral direction in such a way as to form part respectively of a first and a second row of chambers, as well as a U-shaped elementary path extending substantially in a plane perpendicular to the longitudinal direction from one to the other of said chambers in order to circulate a first fluid in thermal contact with a second fluid, two chambers of a same row, belonging to two neighboring pockets of the stack, being delimited in the longitudinal direction by respective walls placed one against the other, certain of these walls being provided with openings allowing a leaktight communication of fluid between the adjacent chambers, the exchanger additionally comprising an inlet pipe and an outlet pipe for the first fluid, disposed at a first longitudinal end of the exchanger, substantially in the alignment of said first and second rows respectively, and each communicating with one of the chambers.

Heat exchangers of this kind are especially used as evaporators in air-conditioning loops of vehicles, the first fluid being a coolant fluid circulating in the loop and the second fluid being air meant for the passenger compartment of the vehicle.

The object of the invention is to propose an arrangement of inlet and outlet pipes which allows a reduction in the space taken up by the heat exchanger, both when the first fluid circulates in four passes and when it circulates in six passes.

The invention especially relates to a heat exchanger of the type defined in the introduction and envisages that one at least of said pipes communicates with the corresponding chamber via an end box supplementing the stack of pockets at said first end.

Optional characteristics of the invention, complementary or substitutional, are set out below:

- The end box defines two separate compartments situated respectively in the alignment of the two rows, each of said pipes communicating with the corresponding chamber via one of said compartments.
- The compartment communicating with the inlet pipe is connected to the upstream end of an injection tube which traverses a part of the stack of pockets, in the longitudinal direction, so as to lead the first fluid to a first-row chamber remote from the first end.
- Said U-shaped elementary paths define a circulation of the first fluid in six passes, the first and fifth passes starting from first-row chambers, the second and sixth passes ending at second-row chambers, the third pass starting from second-row chambers and the fourth pass ending at first-row chambers.
- The end box defines a unitary interior space situated in part in the alignment of each of the two rows and communicating directly with the outlet pipe, the inlet pipe being connected to an injection tube which traverses the end box and a part of the stack of pockets, in the longitudinal direction, so as to lead the first fluid to a first-row chamber remote from the first end.
- Said interior space communicates with the adjacent first-row chamber by an annular passage surrounding the injection tube.
- Said U-shaped elementary paths define a circulation of the first fluid in four passes, the first pass starting from first-row chambers, the second pass ending at second-row chambers, the third pass starting from second-row chambers and the fourth pass ending at first-row chambers.
- The inlet and outlet pipes are mutually staggered in height, the end box extending over a height greater than the chambers, partially opposite said U-shaped elementary paths.
- The end box is formed by a flat and vertical end plate and by a dished plate joined, at its periphery and, if necessary, in a median zone separating the two compartments, in a leaktight manner to the inner face of the end plate.
- The end plate, and optionally the dished plate, extend substantially over the full height of the exchanger.
- The end plate and the dished plate are parts of a unitary plate mutually connected by a fold line.

The characteristics and advantages of the invention will be set out in greater detail in the following description, with reference to the appended drawings.

Figure 1:
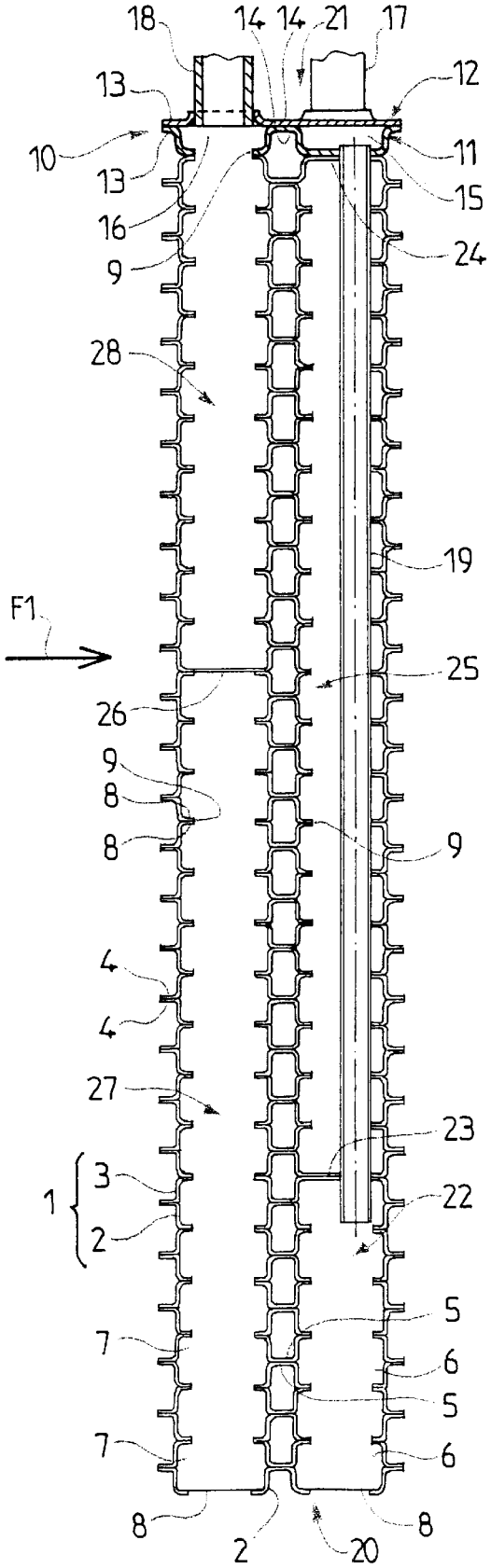
FIG. 1 is a cross-sectional top view of a first embodiment of an evaporator according to the invention.

FIG. 1 represents an evaporator according to the invention, in cross section along the plane passing through the axes of the two rows of chambers. This evaporator is essentially constituted by a stack of pockets and of corrugated inserts such as described, for example, in FR 2 747 462 A, to which reference can be made for more details on the structure of this stack. Each pocket 1 is formed from two sheet-metal plates dished in the shape of basins 2 and 3. These latter are mutually identical and have their concavities facing each other, i.e. toward the top and bottom of the figure respectively. In a plane perpendicular to that of the figure, each basin has a peripheral edge 4 and a median junction zone 5 connecting to this at the upper end of the basin and continuing downward to the vicinity of its lower end. The peripheral edges 4 and the junction zones 5 of the two basins forming a pocket are mutually assembled in a fluid-tight manner, for example by soldering, in order to delimit the interior space of the pocket. This interior space comprises two chambers 6 and 7, which are situated on either side of the zones 5, respectively to the right and left of the figure, defined by deep dishes of the plates 2, 3, and are mutually connected by a U-shaped elementary path for the coolant fluid. The chambers 6 and 7 occupy a minority fraction of the height of the evaporator in the upper part of the latter, the U-shaped elementary path extending over the rest of the height, behind the plane of the figure, and over a lesser thickness in the longitudinal direction. Neighboring plates 2 and 3 belonging to two different pockets are mutually supported by their backs 8, opposite the chambers 6 and 7, and are mutually separated, opposite the U-shaped paths, by a gap furnished with a corrugated insert defining an elementary path for the air to be cooled, in parallel with the plane of the figure, according to the arrow Fl. The mutually touching backs 8 are soldered together and certain of them are traversed by openings 9 providing mutual communication between the corresponding chambers.

The back 8 of the plate 2 situated at that end 20 of the pack facing the bottom of the FIG. 1 is closed in such a way as to separate from the outside the chambers 6 and 7 adjacent to this plate. At the opposite end 21 of the stack of pockets, that is to say toward the top of the figure, an end box 10 is disposed beyond the last pocket 1. The box 10 is formed from two plates, namely a dished plate 11 and a substantially flat end plate 12. Like the plates 2 and 3, the plates 11 and 12 are connected in a leaktight manner by annular zones 13 and by vertical median zones 14, delimiting on either side of these latter two compartments 15, 16 of the interior space of the box 10, enveloped by respective dishes of the plate 11 and respectively aligned with the rows formed by the chambers 6 and 7. An inlet pipe 17 and an outlet pipe 18 of the evaporator are fixed on the plate 12 in such a way as to communicate respectively with the compartments 15 and 16. An injection tube 19 extends longitudinally in the row of chambers 6, traversing the openings 9 which mutually connect these, while leaving a part of the surface of these openings free. A first end of the tube 19 is situated in the compartment 15 and its opposite end is situated in a chamber 6 belonging to a collecting space 22 adjacent to the end 20 of the evaporator, formed by a subassembly of chambers 6 mutually connected by openings 9. The collecting space 22 is limited in the direction of the end 21 by a partition 23 traversed in a leaktight manner by the tube 19. Similarly, the tube 19 traverses in a leaktight manner a partition 24 separating the compartment 15 from the chamber 6 adjacent thereto, this partition being formed by the backs of the dishes of the plates 11 and 3 delimiting this compartment and chamber. The chambers 6 contained between the partitions 23 and 24 mutually communicate through openings 9 to form a collecting space 25. Similarly, the row of chambers 7 is separated by a partition 26 in a collecting space 27 adjacent to the end 20 and a collecting space 28 contained between the partition 26 and the compartment 16 and communicating with the latter through the opening 9 in the terminal plate 3 of the stack and a corresponding opening in the plate 11. The partition 26 is farther away from the end 20 than the partition 23.

The coolant fluid penetrating into the evaporator through the inlet pipe 17 first passes into the compartment 15, whence the injection tube 19 leads it into the collecting space 22. From the collecting space 22, the fluid runs in parallel through the U-shaped elementary paths delimited by the pockets by which it is defined, the branches which communicate with the chambers 6 and those which communicate with the chambers 7 forming a first pass and a second pass respectively, this latter ending at the collecting space 27. Similarly, the U-shaped elementary paths of the pockets contained in the longitudinal direction between the partitions 23 and 26 form a third pass and a fourth pass connecting the collecting spaces 27 and 25, and those of the pockets contained between the partitions 26 and 24 form a fifth pass and a sixth pass connecting the collecting spaces 25 and 28. The fluid originating from the collecting space 28 passes into the compartment 16 then leaves the evaporator by the outlet pipe 18.

It can be seen in FIG. 1 that the pipes 17 and 18 are mutually staggered in the vertical direction, that is to say in the plane perpendicular to the figure. This arrangement has a number of advantages. It allows the width (or thickness) of the evaporator to be reduced, for example to below 60 mm, for compactness in this direction, while still maintaining a sufficient center-to-center distance between the inlet and outlet pipes to avoid fitting problems. If so desired, in order to satisfy the needs of connecting the evaporator to the rest of the air-conditioning loop, it also allows the inlet and outlet pipes to be bent for guidance in the lateral direction, while still being disposed one above the other so as to limit the space requirement in the longitudinal direction.

As shown in FIG. 1, the injection tube 19 is advantageously offset to the right relative to the centers of the openings 9, that is in the direction downstream of the air flow F1.

Figure 2:
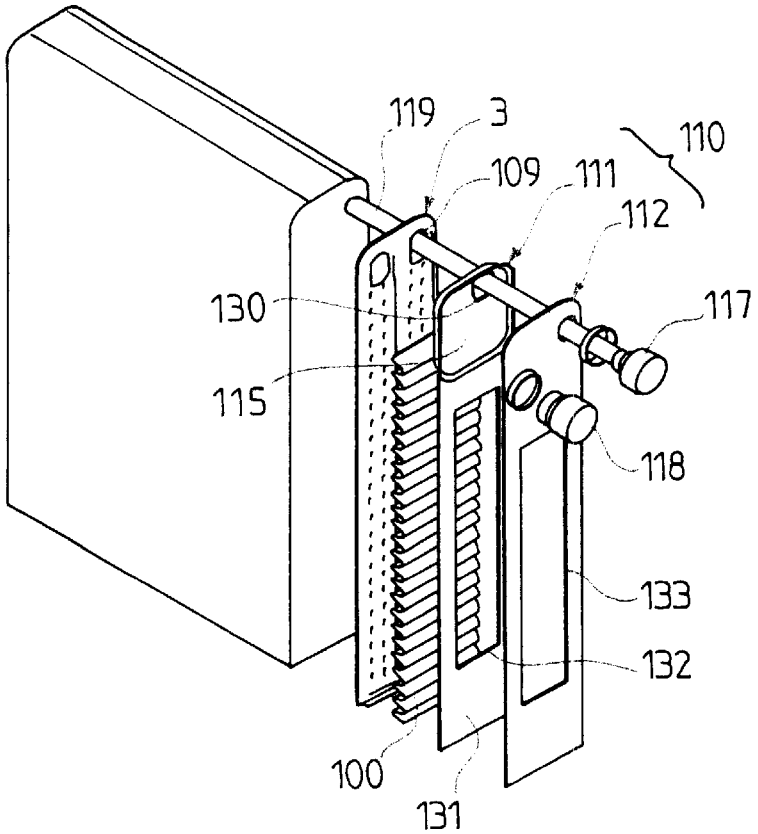

FIG. 2 diagrammatically represents an evaporator according to the invention, in which the coolant fluid circulates in four passes. This evaporator comprises a stack of pockets and inserts as previously described, only one plate 3, belonging to an end pocket, and one insert 100 being represented. Coupled with this plate 3 is a dished plate 111, which forms with a substantially flat plate 112 an end box 110. An injection tube 119 analogous to the tube 19 of FIG. 1 is joined in a leaktight manner to an inlet pipe 117 situated opposite the outer face of the plate 112, the whole traversing this plate in a leaktight manner. An outlet pipe 118, fixed in such a way as to project equally over the outer face of the plate 112, communicates with the unitary interior space 115 of the box 110, which space surrounds the tube 119. A partition (not represented) divides into two collecting spaces the chambers of the row into which the tube 119 passes. In contrast, the chambers of the other row all mutually communicate to form a single collecting space and are separated from the interior space 115 by the back of the dish of the plate 111.

The coolant fluid penetrating through the inlet pipe 117 passes directly into the injection tube 119 which leads it into that collecting space of the first row which is farthest away from the pipe 117. The fluid circulates in the U-shaped elementary paths along a route made up of four passes, which route leads it back into that collecting space of the first row which is adjacent to the box 110, whence it reaches the interior space 115 by a defined annular passage, around the tube 119, through an opening 109 in the plate 3 adjacent to the plate 111 and an opening 130 in this latter. Finally, the fluid leaves the space 115, and the evaporator, through the outlet pipe 118.

It can be seen in FIG. 2 that the pipes 117 andll8, like the pipes 17 and 18 of FIG. 1, are mutually staggered in height. This implies in general terms for the interior space 115, as for the compartments 15 and 16 of FIG. 1, a height greater than that of the chambers of the pockets, this interior space extending therefore, in part, opposite the U-shaped elementary paths.

In the evaporator of FIG. 2, the plates 111 and 112 extend over the full height of the evaporator, that part 131 of the plate 111 which is situated below the interior space 115 being flat and vertical and being coupled with the plate 112. These two plates have cavities 132, 133 designed to lighten the evaporator.

The evaporator of FIG. 3 differs from that of FIG. 2 solely by the omission of the flat part 131 of the plate 111, below its annular junction zone with the plate 112, which in no way, of course, affects the working of the evaporator.

Figure 4:
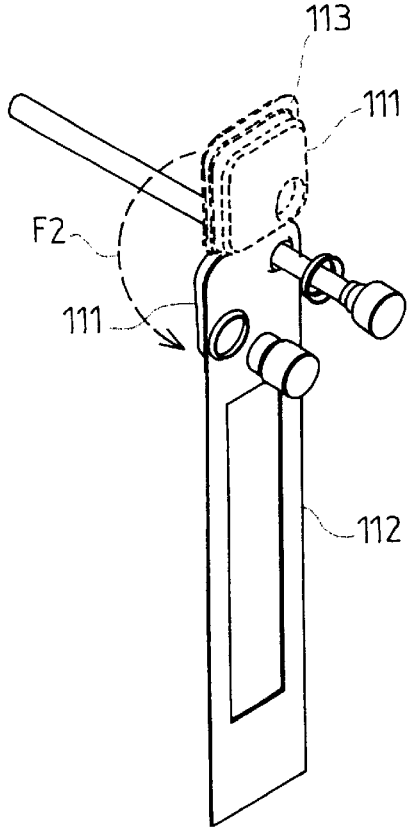
FIGS. 2 to 4 are partial perspective views of other embodiments of an evaporator according to the invention.
Figure 3:
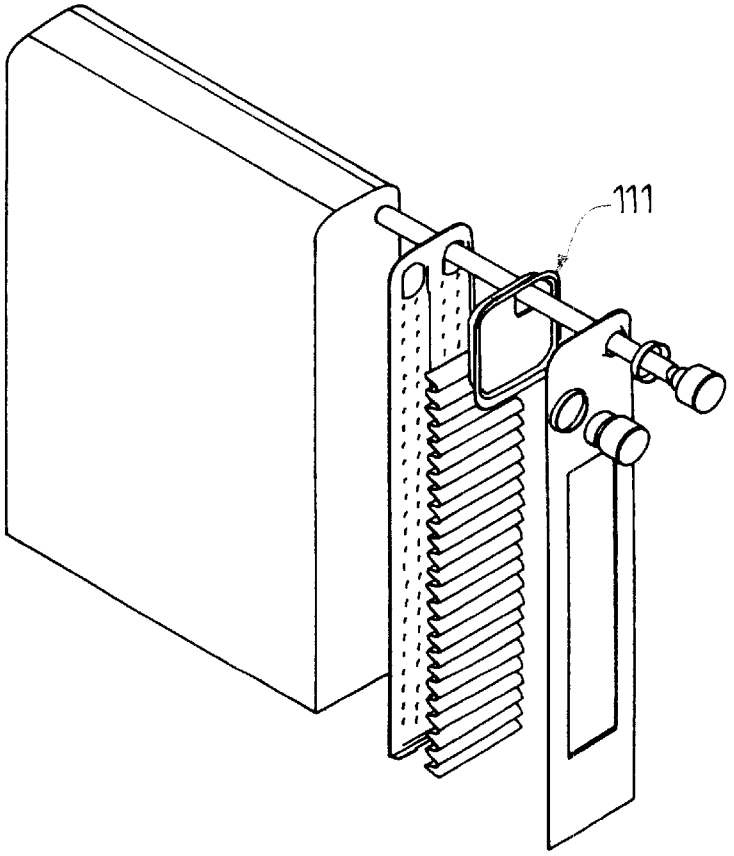

Finally, FIG. 4 shows plates 111 and 112 similar to those of FIG. 3, realized by cutting, drawing and folding from a single, flat metal sheet. The plate 111 obtained after cutting and drawing, disposed above the plate 112, its peripheral edge 113 being situated in the plane of the plate 112, can be seen in the form of a dashed line. The definitive position of the plate 111 is obtained by a 180° rotation about a horizontal fold line, according to the arrow F2.

In the above description, the indications regarding the orientation or spatial position of the elements relate to a particular orientation of the evaporator and will consequently need to be amended should this orientation be changed.

What is claimed is:

1. A heat exchanger, for a vehicle air-conditioning loop, comprising a multiplicity of pockets (1) mutually stacked in a longitudinal direction an each defining two chambers (6,7) juxtaposed in a lateral direction in such a way as to form part respectively of a first and a second row of chambers, as well as U-shaped elementary path extending substantially in a plane perpendicular to the longitudinal direction from one to the other of said chambers in order to circulate a first fluid in thermal contact with a second fluid, two chambers of a same row, belonging to tow neighboring pockets of the stacks, being delimited in the longitudinal direction by respective walls placed one against the other, certain of these walls (8) being provided with openings (9) allowing a leaktight communication of fluid between the adjacent chambers, the exchanger additionally comprising an inlet pipe (17) and an outlet pipe (18) for the first fluid, disposed at a first longitudinal end (21) of the exchanger, substantially in the alignment of said first and second rows respectively, and each communicating with one of the chambers, wherein one at least (17, 18) of said pipes communicates with the corresponding chamber via an end box (10) supplementing the stack of pockets at said first end, wherein the end box is formed by a flat and vertical end plate (12) and by a dished plate (11) disposed between said end plate (12) and said stack of pockets at said first end, said end plate (12) and dished plate (12) being joined along a periphery (13), and wherein said dished plate (11) is joined in a leaktight manner to an inner face of the end plate in a median zone (14) to define two separate compartments (15, 16) in an interior of said end box (10).

2. The heat exchanger as claimed in claim 1, in which the two separate compartments (15, 16) are situated respectively in the alignment of the two rows, each of said pipes (17, 18) communicating with the corresponding chamber via one of said compartments.

3. The heat exchanger as claimed in claim 2, in which the compartment (15) communicating with the inlet pipe (17) is connected to the upstream end of an injection tube (19) which traverses a part of the stack of pockets, in the longitudinal direction, so as to lead the first fluid to a first-row chamber remote from the first end.

4. The heat exchanger as claimed in claim 2, in which said U-shaped elementary paths define a circulation of the first fluid in six passes, the first and fifth passes starting from first-row chambers (6), and the second and sixth passes ending at second-row chambers (7), the third pass starting from second-row chambers (7) and the fourth pass ending at first-row chambers (6).

5. The heat exchanger as claimed in claim 1, in which the end box (110) defines a unitary interior space (115) situated in part in the alignment of each of the two rows and communicating directly with the outlet pipe (118), the inlet pipe (117) being connected to an injection tube (119) which traverses the end box and a part of the stack of pockets, in the longitudinal direction, so as to lead the first fluid to a first-row chamber remote from the first end.

6. The heat exchanger as claimed in claim 5, in which said interior space communicates with the adjacent first-row chamber by an annular passage (109, 130) surrounding the injection tube (119).

7. The heat exchanger as claimed in claim 6, in which said U-shaped elementary paths define a circulation of the first fluid in four passes, the first pass starting from first-row chambers, the second pass ending at second-row chambers, the third pass starting from second-row chambers and the fourth pass ending at first-row chambers.

8. The heat exchanger as claimed in claim 1, in which the inlet and outlet pipes are mutually staggered in height, the end box extending over a height greater than the chambers, partially opposite said U-shaped elementary paths.

9. The heat exchanger as claimed in claim 1, in which the end box is formed by a flat and vertical end plate (12) and by a dished plate (11) joined, at its periphery (13) and, if necessary, in a median zone (14) separating the two compartments, in a leaktight manner to the inner face of the end plate.

10. The heat exchanger as claimed in claim 1, in which the end plate, and the dished plate, extend substantially over a full height of the exchanger.

11. The heat exchanger as claimed in claim 1, in which the end plate and the dished plate are parts of a unitary plate mutually connected by a fold line.

12. The heat exchanger as claimed in claim 1, further comprising an injection tube (19), which traverses a part of the stack of pockets in the longitudinal direction so as to lead the first fluid to a first-row chamber remote from the first end, said injection tube (19) passing through said dished plate into one of said two separate compartments.

* * * * *